US008904565B2

(12) United States Patent
Barrett Barber

(10) Patent No.: US 8,904,565 B2
(45) Date of Patent: Dec. 9, 2014

(54) OUTERWEAR GARMENTS IN COMBINATION WITH SEPARATE GARMENTS

(71) Applicant: Montauk LLP, Singapore (SG)

(72) Inventor: Neil Barrett Barber, Singapore (SG)

(73) Assignee: Montauk LLP, Singapore (SG)

( * ) Notice: Subject to any disclaimer, the term of this patent is extended or adjusted under 35 U.S.C. 154(b) by 0 days.

(21) Appl. No.: 13/866,075

(22) Filed: Apr. 19, 2013

(65) Prior Publication Data

US 2014/0109289 A1 Apr. 24, 2014

(30) Foreign Application Priority Data

Oct. 19, 2012 (IT) ..... MI2012A1773

(51) Int. Cl.

| | |
|---|---|
| ***A41D 1/02*** | (2006.01) |
| ***A41D 1/04*** | (2006.01) |
| *A41D 15/00* | (2006.01) |

(52) U.S. Cl.

CPC ..... *A41D 1/02* (2013.01); *A41D 2400/70* (2013.01); *A41D 1/04* (2013.01); *A41D 15/00* (2013.01)

USPC ..... 2/95; 2/69

(58) Field of Classification Search

USPC ..... 2/95, 103, 112, 104, 109, 107, 117, 2/106, 119, 121, 69, 85, 88, 92, 93, 97, 2/108, 115, 122, 300, 304, 305

See application file for complete search history.

(56) References Cited

U.S. PATENT DOCUMENTS

| | | | | | |
|---|---|---|---|---|---|
| 399,436 | A | * | 3/1889 | Reinhard | 2/95 |
| 622,010 | A | * | 3/1899 | Lowe | 2/67 |
| 642,912 | A | * | 2/1900 | Lowe | 2/105 |
| 685,994 | A | * | 11/1901 | Levitas et al. | 2/95 |
| 789,015 | A | * | 5/1905 | Fisher | 2/95 |
| 1,254,043 | A | * | 1/1918 | James | 450/31 |
| 1,271,047 | A | * | 7/1918 | McQuarrie | 2/95 |
| 1,464,449 | A | * | 8/1923 | Silverstein | 2/95 |
| 1,476,228 | A | * | 12/1923 | Spilman | 2/95 |
| 1,915,597 | A | * | 6/1933 | Ducker | 2/95 |
| 2,121,513 | A | * | 6/1938 | Smith | 24/370 |
| 2,135,020 | A | * | 11/1938 | Young | 24/356 |
| 2,508,331 | A | * | 5/1950 | Dunlap | 2/122 |
| 4,296,498 | A | | 10/1981 | Vinson | |
| 4,797,954 | A | * | 1/1989 | Williams et al. | 2/106 |
| 7,028,342 | B1 | | 4/2006 | Nordstrom et al. | |

FOREIGN PATENT DOCUMENTS

| | | | |
|---|---|---|---|
| CH | 602029 | A5 | 7/1978 |
| DE | 202006004093 | U1 | 5/2006 |

* cited by examiner

*Primary Examiner* — Amy Vanatta
(74) *Attorney, Agent, or Firm* — Robert E. Alderson, Jr.

(57) ABSTRACT

Articles of clothing which include an outerwear garment combined with an intermediate garment are provided. Such articles include a jacket combined with a vest, a coat or overgarment combined with a jacket, or a coat or overgarment combined with a vest. Such articles of clothing can include an outerwear and an intermediate garment, wherein the outwear and the intermediate garment include respective shoulders, wherein the outwear outerwear and the intermediate garment may be joined at the shoulders by connecting members.

6 Claims, 3 Drawing Sheets

OUTERWEAR GARMENTS IN COMBINATION WITH SEPARATE GARMENTS

CROSS REFERENCE TO RELATED APPLICATION

This application claims priority to and benefit of Italian Patent Application No. MI2012A001773 filed Oct. 19, 2012, the contents of which are incorporated by reference in their entirety.

FIELD OF THE INVENTION

The present invention relates to combined clothing items, in particular outerwear that is combined with an intermediate garment.

BACKGROUND OF THE INVENTION

Garments such as those described herein above are quite common in clothing, especially in men's clothing. In particular, combining a jacket with a vest is typical of men's clothing of a classic type, especially during cool or cold weather. However, even in cool or cold weather it is sometimes necessary or desirable to rest the jacket on the shoulders, rather than wearing it in a conventional fashion. In so doing, the jacket can easily drop from the shoulders, unless the movement of the jacket wearer is limited to prevent this.

The same problem exists when wearing an overgarment on a jacket. In such cases, it is not infrequent that the need arises simply to rest the overgarment on the shoulders, again creating a risk of it dropping to the ground.

SUMMARY OF THE INVENTION

The present invention provides comfortable and easy-to-use systems that avoid the above-mentioned drawbacks.

This is achieved by systems and items of clothing as set forth in the annexed claims.

Further characteristics and advantages of the present invention will be more clearly understood from the description of exemplary embodiments, given herein below by way of indicative, non-limiting examples, with reference to the following Figures.

DETAILED DESCRIPTION

Figure 1A:
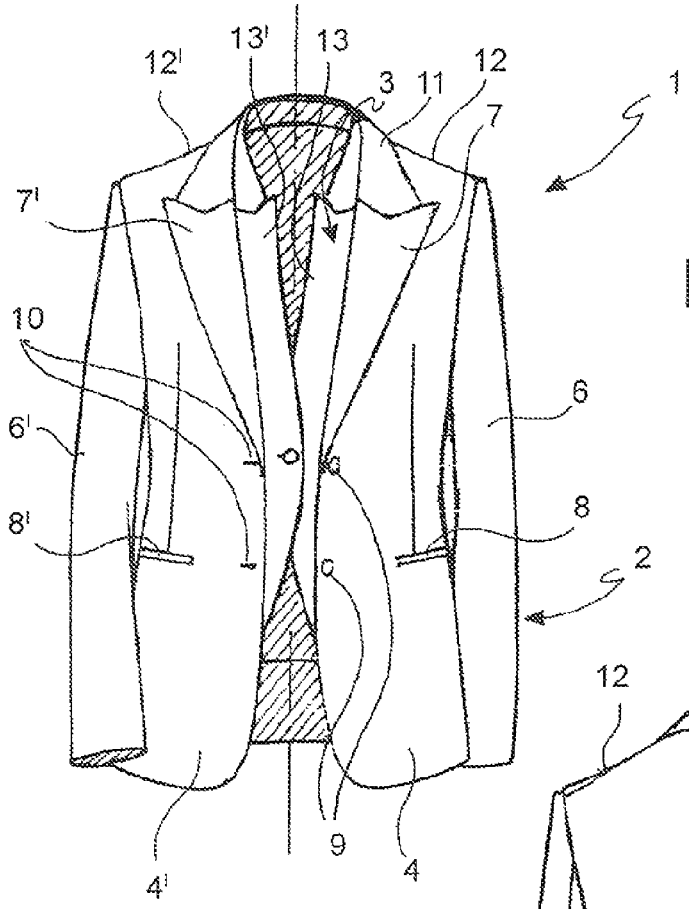
FIG. 1A represents a front view of a combined clothing item.
Figure 1B:
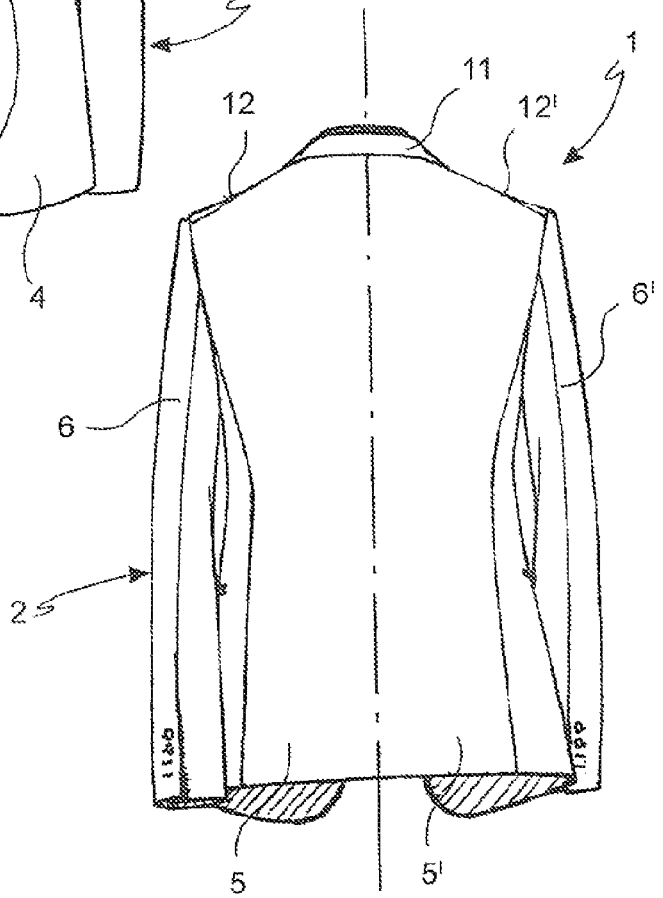
FIG. 1B represents a rear view of the item of clothing of FIG. 1A.
Figure 2A:
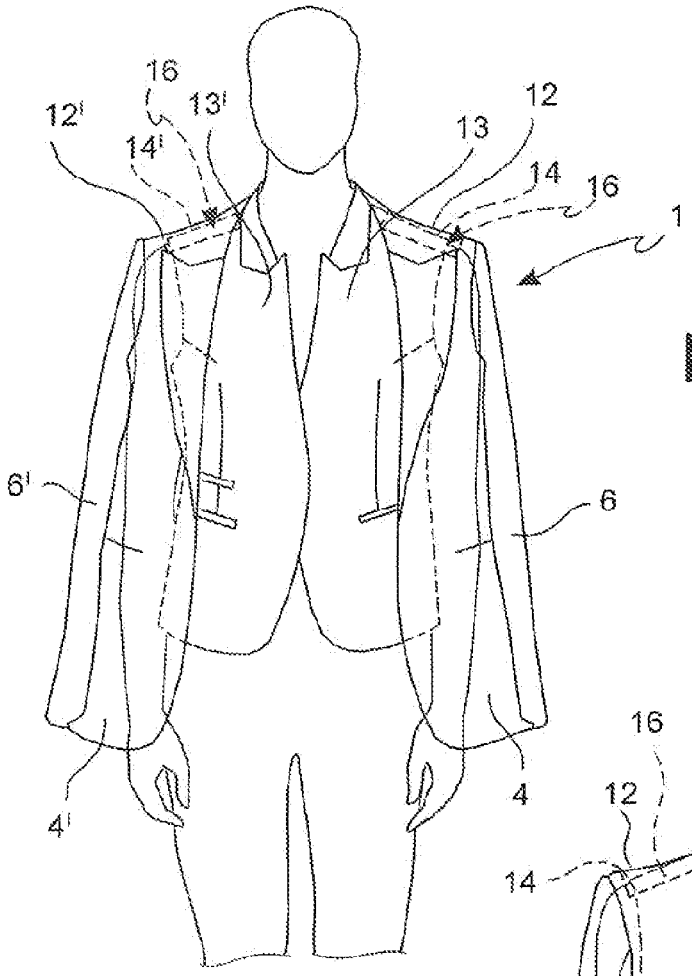
FIG. 2A represents a front view of an item of clothing worn in an informal manner.
Figure 2B:
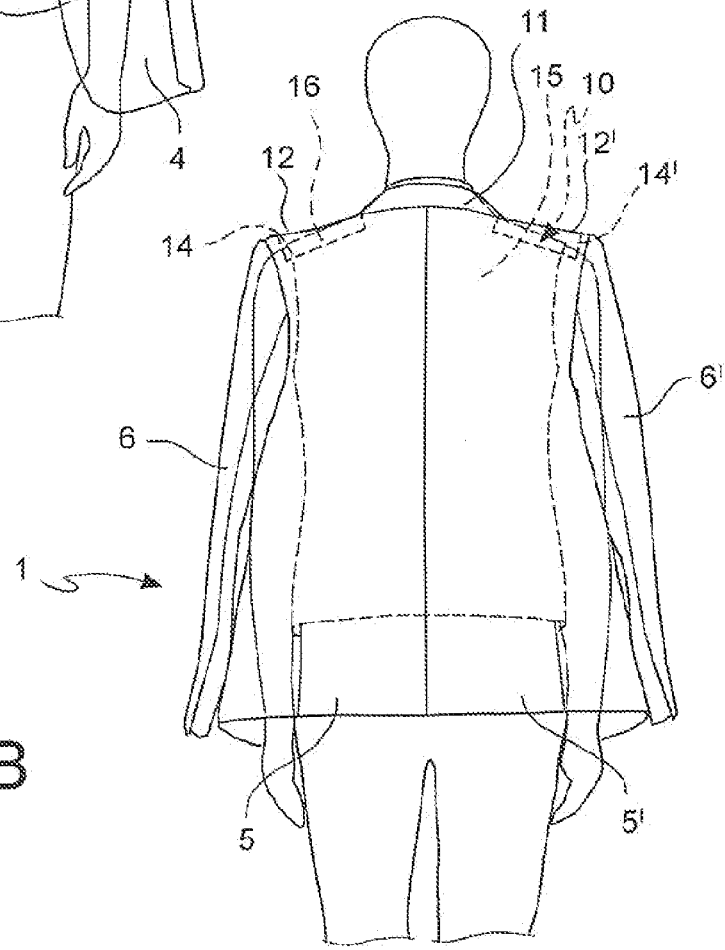
FIG. 2B represents a rear view of the item of clothing of FIG. 2A.

Clothing items according to the present invention include combined garments comprising particular outerwear and an intermediate garment. The term "particular outerwear" relates to garments provided with shoulders, such as jackets, coats, and other overgarments, etc.

Typical examples of clothing items according to the invention are a jacket combined with a vest, a coat or overgarment combined with a jacket, a coat, overgarment or particular outerwear combined with a vest, a raincoat combined with a vest, a peacoat combined with a vest and other such combinations.

In the following description, with reference to the annexed Figures, a jacket combined with a vest will be described by way of exemplary, non-limiting example.

Items of clothing of the invention, generally indicated with the numeral 1, may include a jacket 2 and a vest 3.

The jacket 2 may include two front flaps 4, 4', two rear flaps 5, 5' and two sleeves 6, 6'.

The rear flaps 5, 5' may be joined by a seam that ends at the lower edge, or slightly thereabove.

Each of the front flaps 4, 4' may include a cuff 7, 7', pockets 8, 8', buttons 9 and respective loops 10. The two cuffs 7, 7' may be joined by a collar 11.

The front 4, 4' and rear 5, 5' flaps may be joined at the respective shoulders 12, 12'.

The vest 3 may include, in turn, two front flaps 13, 13', joined at the shoulders 14, 14' to a rear flap 15.

Figure 3:
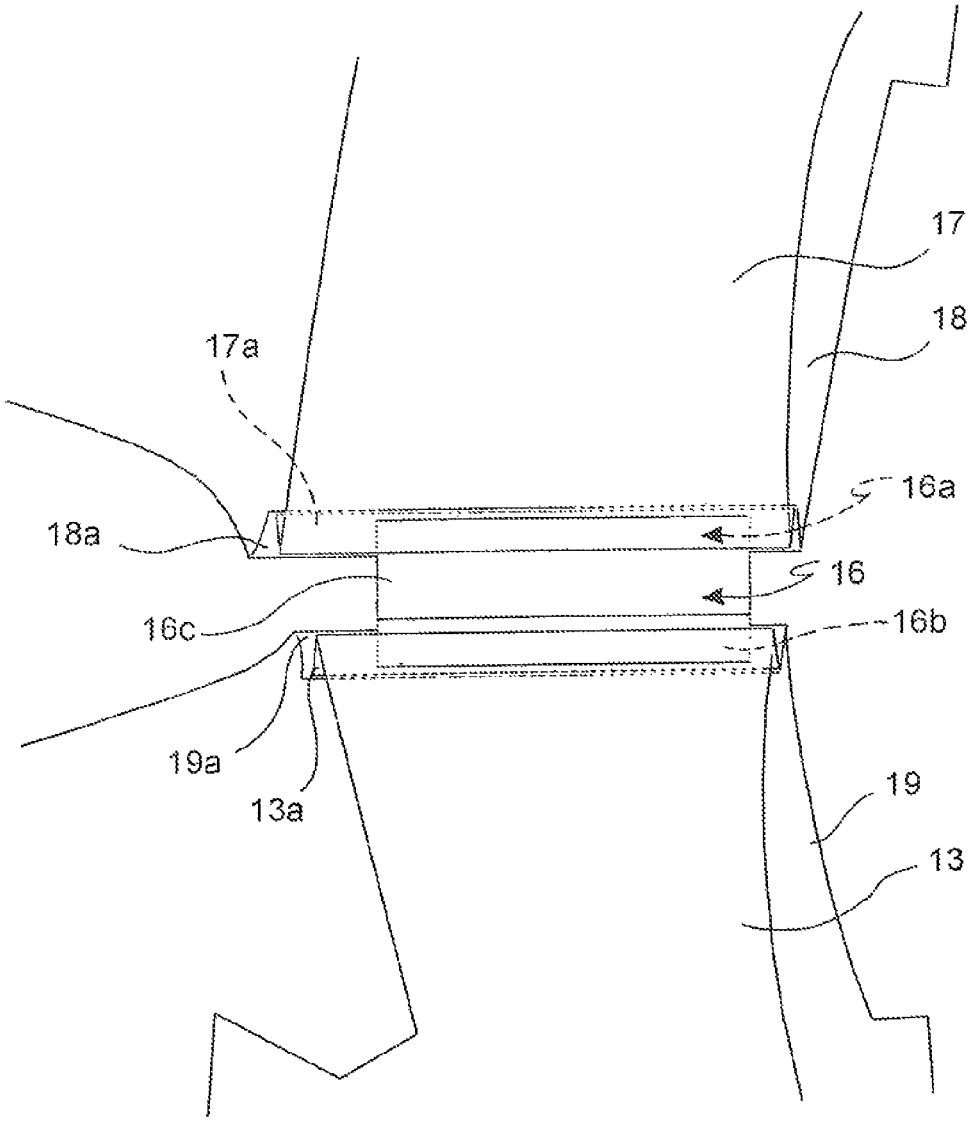
FIG. 3 represents an exploded view showing details of the item of clothing of FIG. 2A.

The particular outerwear and the intermediate garment, specifically in this case a jacket and a vest, may be joined at respective shoulders 12, 12' and 14, 14' by a connecting member 16, as shown in detail in FIG. 3.

In certain embodiments, the connecting member 16 may be a fabric flap of a substantially rectangular shape, including a first joining portion 16*a* for the attachment to the shoulder 12, 12' of the particular outerwear, a second joining portion 16*b* for the attachment to the shoulder 14, 14' of the intermediate garment, specifically in this case the vest, and a central portion 16*c* providing clearance between the two garments.

In certain embodiments, the first joining portion 16*a* of the connecting member 16 may be secured between the folded edges 17*a*, 18*a* of the covers 17, 18, respectively, of each front flap 4, 4' and of each rear flap 5, 5' of the particular outerwear 2. Vice versa, the second joining portion 16*b* may be secured between the folded edges 13*a*, 19*a*, respectively, of each front flap 13, 13' and of the cover 19 of the rear flap 15 of the intermediate garment 3, such as a vest.

The connecting member 16 may be secured to the particular outerwear 2 and to the intermediate garment 3, for example by seams.

In a different embodiment, joining may be carried out using a hook-and-loop fastener (like VELCRO), so as to make the coupling between the two garments reversible. In other embodiments, the joining portions 16*a*, 16*b* may include one or more buttons couplable with inner loops to form a connection within the folded edges 17*a*, 18*a*, 13*a*, and 19*a* of the two garments 2, 3.

In certain embodiments, the joining portions 16*a*, 16*b* and the folded edges 17*a*, 18*a* and 13*a*, 19*a* may include snap-type buttons instead of conventional buttons and loops.

In other embodiments, the joining portions 16*a*, 16*b* and the folded edges 17*a*, 18*a* and 13*a*, 19*a* may be connected using a zipper.

The shape of the connecting member 16 may be rectangular, but also be any shape that allows coupling of two garments 2, 3 as described above. Furthermore, it is not necessary that the connecting member 16 extends the entire length of the shoulders 12, 12' and 14, 14', it being sufficient that only a portion thereof is stably joined.

The connecting member 16 may be made of various materials, such as material employed for the cover or the fabric of the article of clothing. In certain embodiments, it may be preferable to use a fabric having low thickness.

From what has been described above, it is apparent that combined items of clothing according to the invention may be easily worn in a classical manner, that is, by sliding one's arms into the armhole of the intermediate garment, such as a vest, and into the sleeves 6, 6' of the particular outerwear; or, alternatively, it may be worn in an informal manner by sliding one's arms into the armhole of the vest, but leaving the particular outerwear 2 resting on the shoulders. In this case, the connecting member 16 will prevent the garment from slipping from the wearer's shoulders.

It shall be apparent that particular embodiments of the present invention have been described, to which those skilled in the art, based on the present description, will be able to make modifications for adaptation to particular applications, without departing from the scope of the present invention.

The invention claimed is:

1. A combined item of clothing comprising an outerwear and an intermediate garment, wherein said outerwear and said intermediate garment comprise respective shoulders, and wherein said outerwear and said intermediate garment are joined at said shoulders by connecting members, wherein said connecting members comprise fabric flaps comprising a first joining portion for the attachment to the shoulders of the outerwear, a second joining portion for the attachment to the shoulders of the intermediate garment, and a central portion providing a space between the outerwear and the intermediate garment and wherein said connecting members are rectangular in shape, and extend by a length that is less than the length of the shoulder.

2. The clothing of claim 1, wherein said outerwear is selected from the group consisting of a coat, an overgarment, and a jacket, and said intermediate garment is either a jacket or a vest.

3. The clothing of claim 1, wherein the joining portions of said connecting members are secured to said outerwear and to said intermediate garment, respectively, by seams.

4. The clothing of claim 1, wherein the joining portions of said connecting members are reversibly secured to said outerwear and to said intermediate garment by devices selected from the group consisting of: a hook-and-loop fastener, buttons that are couplable with inner loops, snap-type buttons, a zipper and any combination thereof.

5. The clothing of claim 1, wherein the first joining portion of the connecting members is secured between folded edges respectively of covers of each front flap and of each corresponding rear flap of the outerwear, while the second joining portion of the connecting members is secured between the folded edges respectively of each front flap and of the cover of the rear flap of the intermediate garment.

6. The clothing of claim 1, selected from the group consisting of: a jacket combined with a vest, a coat or an overgarment combined with a jacket, a coat, an overgarment or an outerwear combined with a vest, a raincoat combined with a vest, and a peacoat combined with a vest.

* * * * *